United States Patent [19]

Hosaka

[11] 4,214,563

[45] Jul. 29, 1980

[54] EXHAUST GAS TEMPERATURE DETECTION BY INJECTION OF TIME-VARYING CURRENT

[75] Inventor: Akio Hosaka, Yokohama, Japan

[73] Assignee: Nissan Motor Company, Limited, Yokohama, Japan

[21] Appl. No.: 971,082

[22] Filed: Dec. 19, 1978

[30] Foreign Application Priority Data

Dec. 21, 1977 [JP] Japan ..... 52-152837

[51] Int. Cl.[2] ..... F02B 3/08

[52] U.S. Cl. ..... 123/437; 123/489; 60/276; 60/285

[58] Field of Search ..... 123/119 EC, 32 EE; 60/276, 285; 73/23

[56] References Cited

U.S. PATENT DOCUMENTS

| | | | |
|---|---|---|---|
| 4,132,200 | 1/1979 | Asano et al. | 60/285 |
| 4,140,085 | 2/1979 | Rabus et al. | 60/276 |
| 4,153,023 | 5/1979 | Asano et al. | 60/285 |
| 4,156,413 | 5/1979 | Taplin | 60/285 |

*Primary Examiner*—Charles J. Myhre
*Assistant Examiner*—Raymond A. Nelli
*Attorney, Agent, or Firm*—Lowe, King, Price & Becker

[57] ABSTRACT

A mixture control system for an internal combustion engine comprising an exhaust gas sensor and a source of time-varying current connected to the gas sensor to inject thereto a current which varies periodically between two constant values to develop a corresponding periodically varying voltage signal which superimposes a voltage signal developed in response to the ratio of mixture supplied to the engine. An amplitude detector is provided to detect the periodically varying voltage signal to develop a signal representative of the temperature of the gas sensor. The detected voltage signal is compared in a comparator with a reference level corresponding to the operating temperature of the gas sensor to operate the mixture control system in open-loop mode, when the gas sensor is operating below the operating temperature.

12 Claims, 12 Drawing Figures

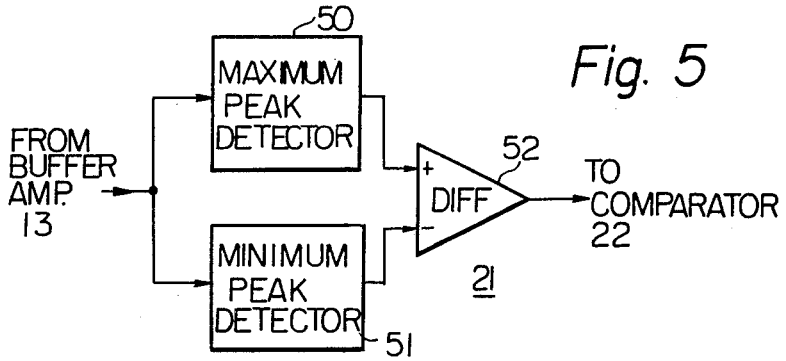
Fig. 5
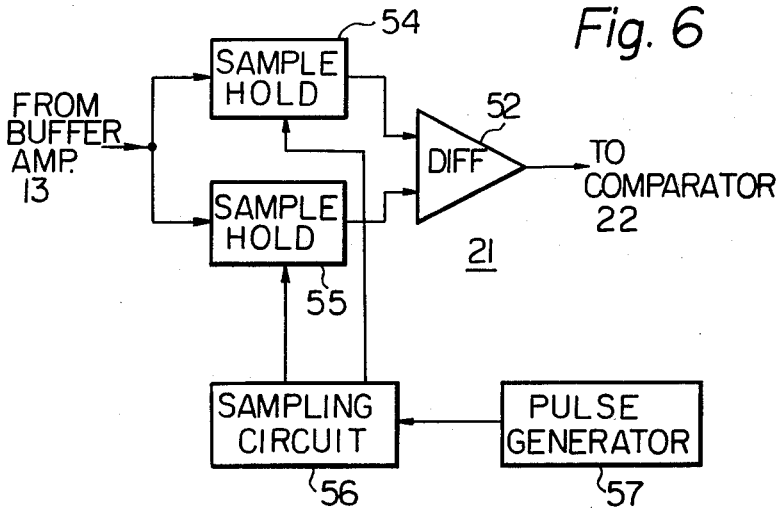
Fig. 6
Fig. 7
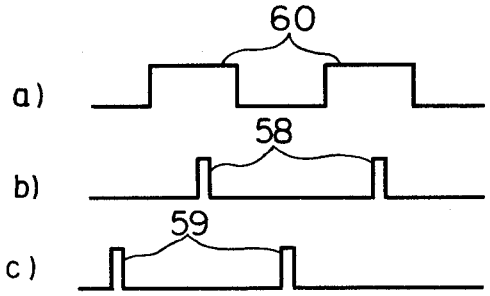

EXHAUST GAS TEMPERATURE DETECTION BY INJECTION OF TIME-VARYING CURRENT

BACKGROUND OF THE INVENTION

The present invention relates generally to closed-loop mixture control systems for internal combustion engines, and more specifically to a mixture control system including a detector for sensing the temperature of the exhaust gas sensor for operating the system in open-loop control mode when the gas sensor is operating below its operating temperature.

DESCRIPTION OF THE PRIOR ART

In a closed-loop controlled internal combustion engine, an exhaust gas sensor is provided in the exhaust system of the engine for generating a feedback signal for controlling the air-fuel ratio of the mixture at a desired value which is usually near the stoichiometric point so that the exhaust gas content is controlled within a narrow range of high conversion efficiencies of a three-way catalytic converter.

When the gas sensor is operating below its normal operating temperature typically after a cold start or during a prolonged idle condition, its internal impedance will become very high. However during normal temperature operations the gas sensor internal impedance decreases to a low value and the voltage thereacross varies in response to the concentration of the sensed gas component such that it takes on a high level for rich mixtures and a low level for lean mixtures.

Copending United States Patent Application Ser. No. 863,604 filed Dec. 28, 1977, now U.S. Pat. No. 4,153,023 discloses a temperature detection system for operating an engine in open-loop mode when the gas sensor temperature is below the normal operating level. The disclosed temperature detection system comprises a source of injecting a DC current to an exhaust gas sensor to develop a voltage signal. Since the internal impedance of the gas sensor varies inversely proportional to temperature, the voltage so developed represents the temperature of the gas sensor. However, the exhaust gas sensor also develops a mixture dependent voltage signal having a voltage level corresponding to the presence or absence of a predetermined constituent of the emissions even though the temperature is low and this voltage signal is superimposed on the signal that is developed in response to the injection current. Therefore, the combined voltage is not an accurate representation of the temperature of the gas sensor. For example, assuming that the injection current is 1 microampere and the combined voltage level is 1.3 volts. If the mixture dependent voltage component is at zero voltage level corresponding to a lean mixture, the internal impedance of the gas sensor is 1.3 megohms which corresponds to a temperature of approximately 320° C. and if such voltage component is at 0.8 volts for a rich mixture the internal impedance is 500 kiloohms which corresponds to a temperature of about 400° C. There is a difference of 80° C. for the same output voltage. Generally, when the vehicle is running at a low speed the rate of temperature rise is very low. Experiments show that, at a vehicle speed of 20 kilometers per hour on a level road, the gas sensor takes approximately 10 minutes to raise its temperature from 320° C. to 400° C. and under idled engine condition it takes 20 minutes for the same temperature rise. Consequently, the resumption of closed loop operation is delayed for a period of ten to twenty minutes and during such period mixture ratio is not controlled to an appropriate point.

SUMMARY OF THE INVENTION

An object of the present invention is to overcome the above-mentioned problem by injecting a time-varying current to the exhaust gas sensor and detecting the amplitude of the resultant voltage.

Another object of the invention is to provide a mixture control system incorporating a time-varying current source in which the current source is disabled when the control system is allowed to operate the engine in closed-loop control mode.

Specifically, the injection current source has a high impedance value relative to the internal impedance of the gas sensor so that the amplitude of the time-varying current essentially remains constant despite variations in the internal impedance of the gas sensor. The current injected into the exhaust gas sensor develops a voltage which is a product of the current and the internal impedance of the gas sensor. The time-varying current may be any of an alternating sinusoidal waveform, bipolar pulses, a triangular or sawtooth waveform, or unipolar pulses, in so far as the amplitude and the repetition frequency are maintained constant. An amplitude detector is provided to detect the amplitude of the time-varying component of the gas sensor output. Specifically, the amplitude detector comprises maximum and minimum peak detectors and a differential amplifier which receives output signals from the peak detectors to develop a differential signal whereby the mixture dependent voltage component is cancelled. The output signal from the amplitude detector is compared with a reference level corresponding to the operating temperature of the gas sensor and if the signal is above the reference level, a disable command signal is provided indicating that the gas sensor temperature is below its operating level. Preferably, the injection current is synchronized in frequency with the revolution of engine crankshaft so that the gas sensor output always corresponds to a predetermined sensed condition, thus eliminating the factors which might adversely affect the temperature detection.

BRIEF DESCRIPTION OF THE DRAWINGS

These and other objects, features and advantages of the invention will become apparent from the reading of the detailed description that follows with reference to the accompanying drawings, in which:

FIGS. 5–6 are illustrations of the embodiments of the amplitude detector of FIG. 1;

FIG. 7 is a timing diagram useful for describing the operation of the embodiment of FIG. 6;

DETAILED DESCRIPTION

Figure 1:
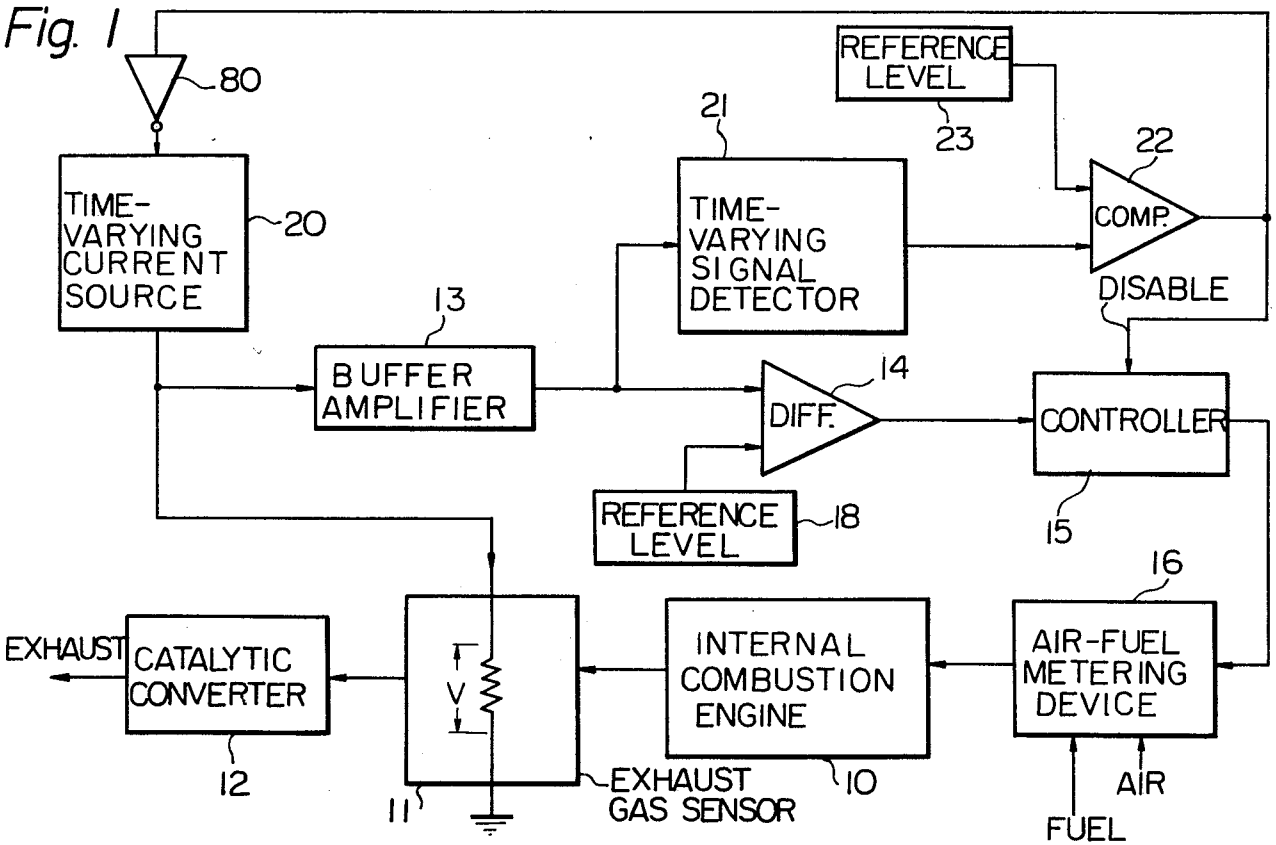
FIG. 1 is a schematic block diagram of a closed-loop mixture control system embodying the present invention.

Referring now to FIG. 1, a closed-loop mixture control system embodying the invention is schematically illustrated. The mixture control system includes an exhaust gas sensor 11, such as zirconia oxygen sensor, disposed in the passage of exhaust gases from the internal combustion engine 10 upstream from a catalytic converter 12. When the sensor environment is switched from a rich to lean gas mixture, the sensor output switches from a high to a low voltage level. The voltage level of the gas sensor 11 is proportional to its internal impedance which is considerably high at low temperatures, i.e. cold start or warm-up periods. Therefore, the internal impedance is an indication that whether the gas sensor 11 is operating properly or not. The sensor output signal is coupled through a unity-gain buffer amplifier 13 to a differential amplifier 14 for comparison with a reference voltage from source 18 representing a desired air-fuel which usually corresponds to a near stoichiometric point. The output signal from the differential amplifier 14 is a signal indicating the deviation of the air-fuel ratio supplied to the engine 10 from the near stoichiometric ratio, the deviation signal being applied to a controller 15 such as proportional and/or integral control circuits wherein the amplitude of the deviation signal is modified in accordance with predetermined control characteristics to minimize the delay response of the feedback system and to minimize the average error of the air-fuel ratio. The correction signal from the controller 15 is supplied to an air-fuel metering device 16 such as electronic carburetor or electronic fuel injector.

In accordance with the invention a time-varying current source 20 is provided to inject a current varying periodically between two constant values to the exhaust gas sensor 11 to develop a corresponding voltage signal across its internal impedance. Since the exhaust gas sensor 11 generates its own voltage signal as mentioned above in response to the sensor environment, the combined voltage V of the gas sensor 11 is $Zi+e$, where Z is the internal impedance of the gas sensor, i, the time-varying current from the time-varying current source 20 and e, the voltage component developed in response to the sensor environment. As will be described later the current injection source 20 has a high internal impedance as compared to the internal impedance of the gas sensor so that the amplitude of the injection current "i" remains essentially constant despite variations of internal impedance Z. The unity-gain buffer amplifier 13 serves to isolate the gas sensor 11 from the circuits connected thereto for utilizing the gas sensor output. Therefore, the voltage at the output of buffer amplifier 13 is a replica of the gas sensor signal having a voltage variation V.

A time-varying signal detector or amplitude detector 21 is connected to the output of the buffer amplifier 13 to detect the voltage component developed in accordance with the injection current "i" in the exhaust gas sensor 11. As will be described hereinbelow, the detector 21 develops a voltage representing the amplitude of the voltage component Zi and supplies it to a comparator 22 wherein it is compared with a reference voltage supplied from a source 23. This reference voltage corresponds to an operating temperature of the gas sensor 11. Since the voltage component Zi is inversely proportional to the temperature of the gas sensor 11, the output signal from the detector 21 is higher than the reference level from source 23 when the sensor temperature is lower than its operating point. The output signal from the comparator 22 is therefore an indication that the temperature of the gas sensor 11 is below that operating point. The comparator output is used as a signal for disabling the controller 15 by overriding the control signal so that under low temperature conditions the mixture control system is operated in open-loop mode.

Figure 2:
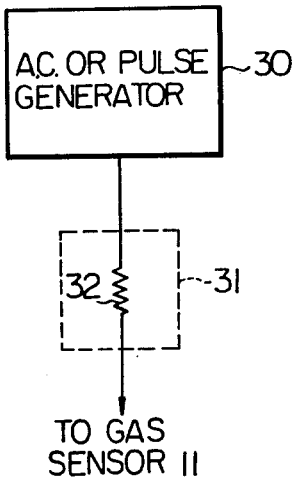
FIGS. 2–4 are illustrations of the embodiment of the time-varying injection current source of FIG. 1.
Figure 3:
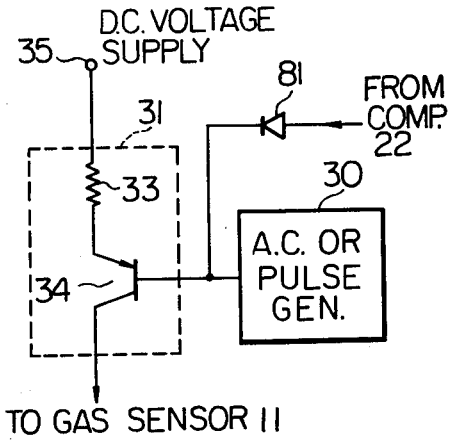
Figure 4:
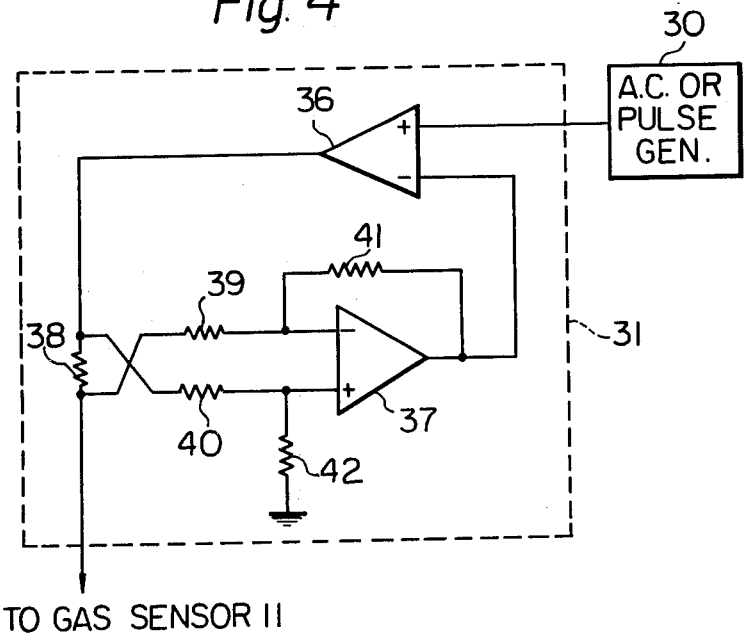

Details of the time-varying current injection source 20 are illustrated in FIGS. 2 to 4. In FIG. 2 the current source 20 is shown as comprising an alternating current pulsating current source 20 at a constant frequency and a constant current source 31, which in this embodiment is represented by a resistor 32 having a high resistance as compared to the maximum internal impedance of the gas sensor 11 so that the amplitude of the injection current remains essentially constant regardless of the impedance variation of the gas sensor. Alternatively, the constant current source 31 may be comprised of a transistor 34 and a resistor 33 connected from a DC voltage supply 35 through the emitter-collector path of the transistor to the exhaust gas sensor 11, as shown in FIG. 3. Since the transistor can be regarded as having an infinite internal impedance, the transistor 34 serves as a current generator that injects current to the gas sensor 11 in response to a signal supplied from the source 30 applied to its base, the injected current having a value that is constant irrespective of changes in the internal impedance of the gas sensor. Alternatively, the constant current source 31 is comprised of two operational amplifiers 36 and 37 in a feedback circuit configuration as illustrated in FIG. 4. The operational amplifier 36 has an infinite value of amplification and develops its output voltage across a resistor 38 in response to an input signal at the noninverting input terminal from the voltage source 30. The operational amplifier 37 is responsive to the voltage across the resistor 38 to provide a feedback control signal to the inverting input of the amplifier 36 such that the voltage across the resistor 38 is maintained to the voltage at the noninverting input of operational amplifier 36. In this embodiment, each of resistors 39 to 41 has an equal resistance value which is much greater than the resistance of resistor 38.

Details of the time-varying signal detector 21 are illustrated in FIGS. 5 and 6. In FIG. 5, the detector 21 is shown as comprising a maximum peak detector 50 and a minimum peak detector 51 having their input terminals connected together to the output of the buffer amplifier 13 and their output terminals connected respectively to input terminals of a differential amplifier 52 whose output terminal is connected to the input of the comparator 22. Since the voltage V developed by the exhaust gas sensor 11 varies between a maximum voltage level which corresponds to $Zi_{max}+e$ and a minimum voltage level corresponding to $Zi_{min}+e$, the output signal from the differential amplifier 52 is a voltage having a value of $Zi_{max}-Zi_{min}$. Therefore, the voltage component "e" is cancelled and the output from the differential amplifier 52 is only indicative of the amplitude of the voltage component which is exactly an inverse function of the gas sensor temperature. Alternatively, the detector 21 comprises a pair of sample-and-hold circuits 54 and 55 having their input terminals connected together to the output of buffer amplifier 13 and their output terminals connected respectively to input terminals of the differential amplifier 52. Sampling pulses 58 and 59, FIGS. *7b* and *7c*, are generated in a sampling circuit 56 in response to input trigger pulses 60, FIG. *7a*, supplied from a pulse generator 57. The sampling circuit 56 may essentially comprise a pair of monostable multivibrators to introduce delay times in response to the leading or trailing edge of the trigger pulses and another pair of monostable multivibrators which are respectively connected to the monostable multivibrators of the first pair of generate a sampling pulse in response to the output signal from the associated monostable. The pulse generator 57 is synchronized with the source 30 or may be dispensed with if the source 30 is a pulse generator and in this case the pulses from the source 30 are directly applied to the sampling circuit 56, as well as to the exhaust gas sensor. Sampling pulses 58 occur during the high voltage level of the injecting pulse current while sampling pulses 59 occur during the low voltage level of the injecting pulses. Sample-hold circuit 54 is triggered in response to the sampling pulse 58 to sample and hold the maximum value of the voltage component Zi and sample-hold circuit 55 is responsive to the sampling pulse 59 to detect the low voltage level of Zi.

Figure 8:
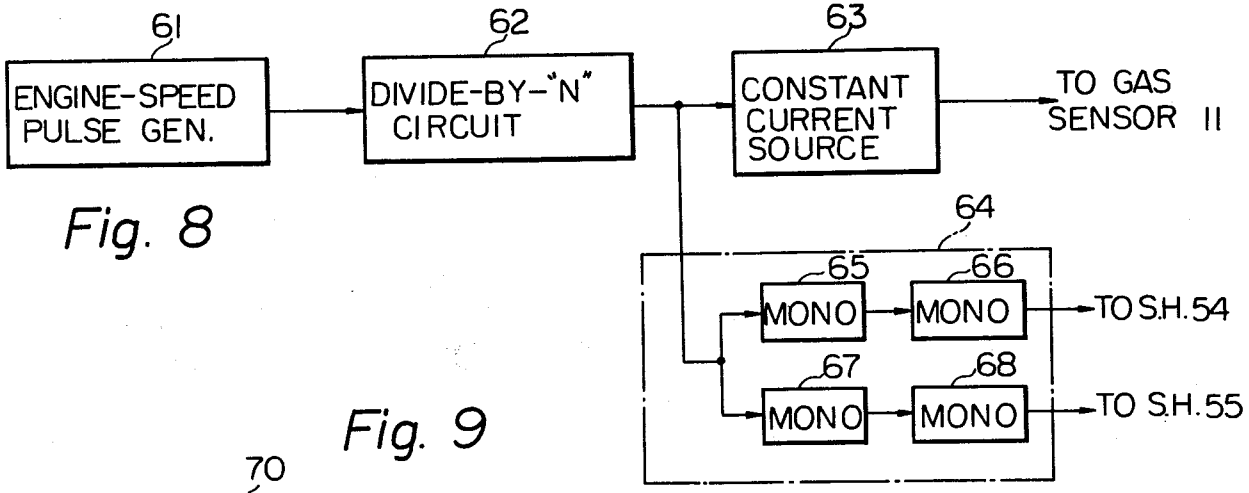
FIG. 8 is an illustration of a modified embodiment of FIG. 6.

Since the amount of emissions from the engine 10 varies essentially in response to the engine crankshaft revolution or engine speed, so that the gas sensor temperature varies accordingly, it is desirable that the sampling intervals be synchronized with or related to the engine revolution. For this purpose the circuit shown in FIG. 8 includes an engine speed pulse generator 61 which essentially comprises an engine speed sensor generating a frequency signal proportional to the engine speed and a pulse shaping circuit. The engine-speed related pulses are coupled to a divide-by-n circuit 62 wherein the signal is divided in frequency to generate a lower frequency pulse train which is supplied on the one hand to the gas sensor 11 through a constant current source 63, and on the other hand to a sampling circuit 64 comprising monostable multivibrators 65 and 66 connected in series to provide a sampling pulse that occurs during the high voltage level of the output from the frequency divider 62 for application to sample-hold circuit 54. Another sampling pulse that occurs during the low voltage level of the frequency divider output is generated by series-connected monostable multivibrators 67 and 68 and applied to sample-hold circuit 55. The signal from the differential amplifier 52 thus represents the AC component Zi that is developed in timed relation with the essentially same exhaust gas environment and is consequently immune to the influence of erratic variations in exhaust emission and mixture ratio.

Figure 9:
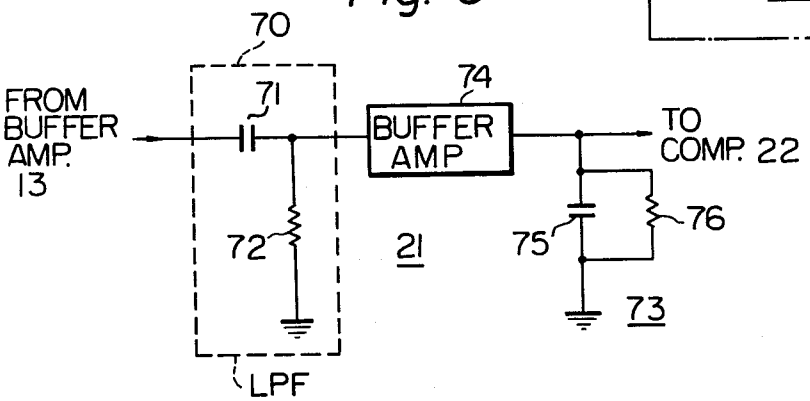
FIG. 9 is an illustration of another embodiment of the amplitude detector of FIG. 1.

A further alternative embodiment of the time-varying signal detector 21 is shown in FIG. 9. This embodiment is suitable in cases where the injection current from the source 30 is an alternating current or bipolar pulsating current, that is, the injection current has no DC component. The output signal from the buffer amplifier 13 is coupled to a highpass filter 70 including a DC decoupling capacitor 71 and a resistor 72, the junction between the capacitor 71 and resistor 72 being connected through a buffer amplifier 74 to a smoothing circuit 73 comprised by a capacitor 75 and a resistor 76 connected in parallel therewith between the output of buffer amplifier 74 and ground. The highpass filter 70 transmits alternating currents above a cutoff frequency corresponding to the frequency of the injected current. The voltage across the smoothing circuit 73 is thus indicative of the amplitude of the alternating voltage component Zi, and applied to the comparator 22 for comparison with the reference voltage from the source 23.

Since the object of the injection of time-varying current to the gas sensor 11 is to sense its internal impedance and therefore the temperature of the gas sensor to operate the control system in open-loop mode, the introduction of such current to the gas sensor is undesirable during the closed-loop operation. For this purpose, the disable signal from the comparator 22 is inverted in polarity by an inverter 80, FIG. 1, and applied to the time-varying current source 20 to cut off the injection current during the closed loop operation. More specifically, this disable signal is coupled through a diode 81, FIG. 3, to the base of transistor 34 to turn it off.

Figures 10, 11:
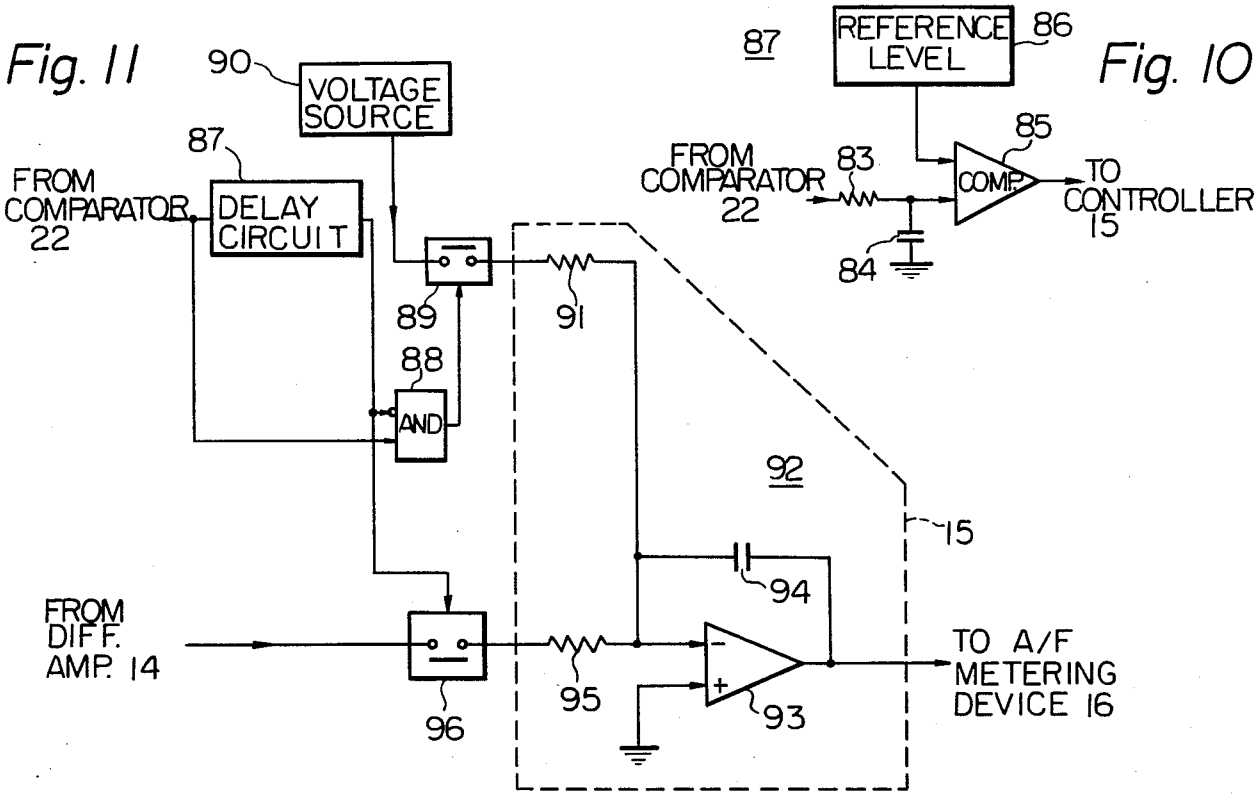
FIG. 10 is an illustration of a delay circuit for delaying the application of a disabling signal to the controller of FIG. 1 for the purpose of not allowing the control system to operate the engine in closed-loop mode until the exhaust gas sensor resumes its normal operating characteristic.
FIG. 11 is an illustration of a modification of the controller of FIG. 1 incorporating the feature of FIG. 10.
Figure 12:
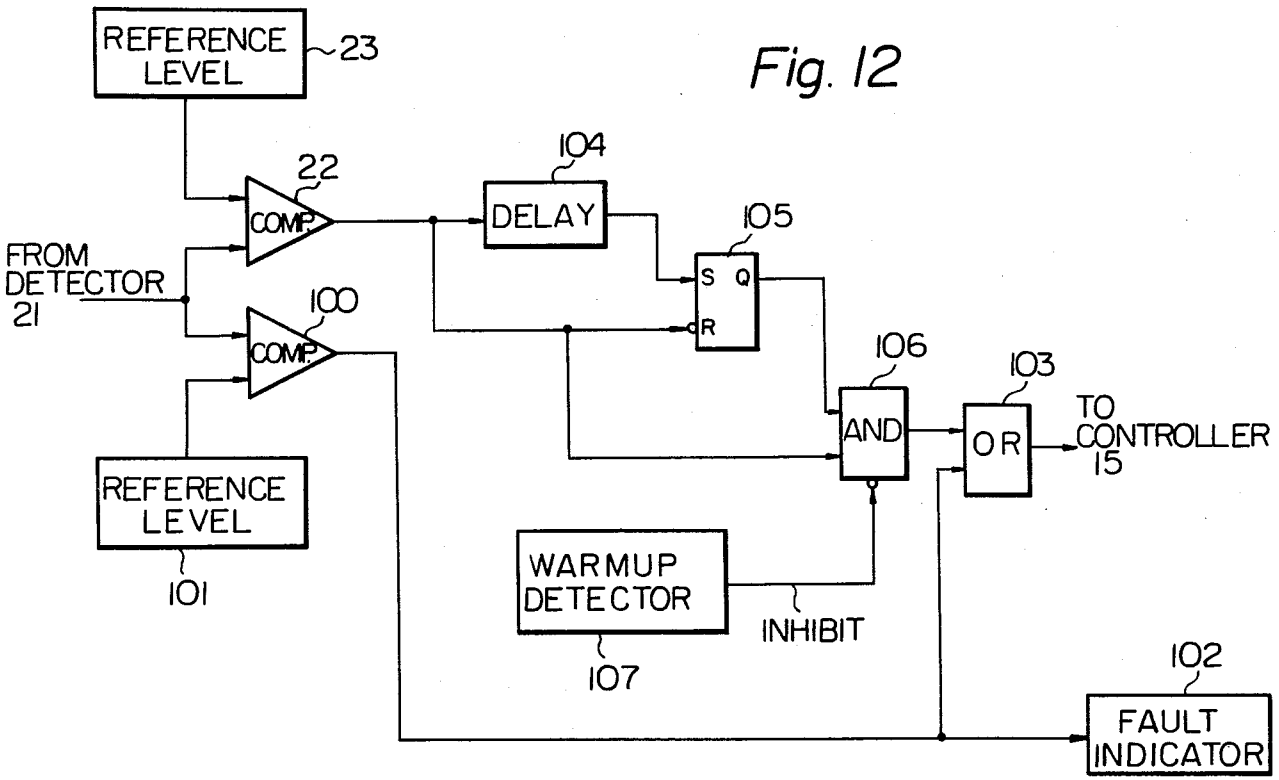
FIG. 12 is an illustration of a modification of the embodiment of FIG. 1.

Because of transient instability of the gas sensor which might occur immediately after the cutoff of the injection current, it is preferable to allow the mixture control system to await until the gas sensor resumes normal operating conditions. For this purpose the disabling signal from the comparator 22 is fed to a delay circuit 87 as illustrated in FIG. 10. This delay circuit comprises an integrator including a resistor 83 and a capacitor 84, and a comparator 85 having an input terminal connected to the junction between the resistor 83 and capacitor 84 for comparison with a reference voltage supplied from a reference level source 86. The voltage across the capacitor 84 rises exponentially and when the reference level is reached the comparator 85 generates an output signal which is applied to the controller 15 as a cutoff command signal therefor.

Another method of overcoming the transient instability of the gas sensor 11 is shown in FIG. 11 in which, during the delay interval of the delay circuit 87, the feedback control signal from the controller 15 is adjusted to a value which is appropriate for the resumption of closed loop operation irrespective of the gas sensor output signal. The output signal from the delay circuit 87 is applied to an inverted input of an AND gate 88 which receives as its other input signal from the signal developed in the comparator 22 so that the output of the AND gate 88 is at a high voltage level during the delay interval. The signal from the AND gate 88 is applied as a gate control signal to an analog switch 89 to pass therethrough a voltage signal from a source 89 which is so adjusted that the air-fuel ratio is controlled to the stoichiometric point, the voltage signal being supplied through a resistor 91 to the inverting input terminal of an operational amplifier 93 which constitutes an integrating circuit with a capacitor 94 and a resistor 95. The capacitor 94 is charged up to the voltage level of the source 90 and the air-fuel ratio is adjusted in accordance with the charged voltage of the capacitor 94. The output signal from the differential amplifier 14, which represents the deviation of the air-fuel ratio from the desired value, is applied through an analog switch 96 and resistor 95 to the operational amplifier 93 in response to the output signal from the delay circuit 87 so that upon the elapse of the delay interval the switch 96 is activated to pass the feedback signal from the differential amplifier 14 to the integral controller 15, and whereupon the mixture control system operates in closed-loop mode in response to the gas sensor output signal.

Since the low voltage condition of the gas sensor 11 is also an indication that the gas sensor has failed due to disconnection or short-circuit, the mixture control system should be disabled until it is repaired or replaced. For this purpose, the output signal from the detector 21 is supplied to a comparator 100 for comparison with a reference level supplied from a source 101 to generate an output signal when the signal from the detector 21 falls below the voltage from source 101 indicating that a failure has occurred in the gas sensor 11. The failure indicating signal is fed to a fault indicator 102 on the one hand, and on the other to the controller 15 via an OR gate 103 as a disable signal to switch the mixture control system to the open-loop mode.

To prevent the system from responding to a short-duration signal from the comparator 22 which can be regarded as a false signal due to the temperature variations corresponding to the varying quantity of exhaust gases as mentioned previously, the comparator 22 output is applied to a delay circuit 104 and thence to the set terminal of a flip-flop 105, whose inverted reset terminal is connected to be responsive to the comparator 22 output. The delay circuit 104 will provide a high voltage signal after a preset delay interval in response to the signal applied thereto to cause the flip-flop 105 to generate a high voltage signal. If the output signal from the comparator 22 is switched to a low voltage level during the preset interval and if there is no signal that follows during that interval, the flip-flop is reset to the low voltage state and the output of an AND gate 106 remains low. If the duration of the comparator 22 output is longer than the preset delay interval, there is a simultaneous presence of output signals from the flip-flop 105 and from the comparator 22, so that the AND gate 106 provides a high voltage signal to permit the system to utilize the output from the comparator 22 as a valid disabling signal which is applied through the OR gate 103 to the controller 15.

If the engine is restarted after it is fully warmed up, the delayed disabling signal might occur when the system is appropriate for closed loop operations. Therefore, it is preferable under such conditions to permit the system to ignore such delayed disabling signal. For this purpose a warm-up presence detector 107 is provided to inhibit the AND gate 106 to thereby prevent the delivery of the disabling signal to the controller 15 as soon as warm-up condition is sensed.

What is claimed is:

1. A mixture control system for an internal combustion engine including an exhaust gas sensor for generating a signal indicative of the concentration of a predetermined constituent of the exhaust gases from said engine, means for deriving a signal representative of the deviation of the concentration indicative signal from a reference value representing a desired air-fuel ratio, and means for supplying mixture of air and fuel to said engine at a variable ratio in response to the deviation of said concentration, said exhaust gas sensor having an internal impedance varying as an inverse function of the temperature of said exhaust gases, said control system comprising: p1 a source of injecting a time-varying current with a magnitude varying periodically between two constant values to said exhaust gas sensor to generate a voltage signal which is the product of the injected current and the internal impedance thereof plus said concentration indicative signal;

a detector for detecting the difference between high and low levels of said voltage signal; and a comparator for comparing said detected voltage signal with a reference level corresponding to an operating temperature of said exhaust gas sensor to generate an output signal indicating that the temperature of said gas sensor is lower than said operating temperature for disabling said feedback control signal.

2. A mixture control system as claimed in claim 1, wherein said source of injecting current comprises a constant current source for injecting a time-varying current to said exhaust gas sensor so that the amplitude of said injected current remains essentially constant regardless of the internal impedance of said exhaust gas sensor.

3. A mixture control system as claimed in claim 1, wherein said detector comprises a maximum peak detector and a minimum peak detector for detecting the maximum and minimum levels of said voltage signal, and a differential amplifier for generating a signal representing the difference between said detected maximum and minimum levels.

4. A mixture control system as claimed in claim 1, wherein said detector comprises a pair of sample-and-hold circuits, a sampling circuit for causing said sample-and-hold circuits to sample said voltage signal at alternate intervals corresponding to the maximum and minimum levels of said voltage signal respectively, and a differential amplifier for generating a signal representative of the difference between the output signals from said sample-and-hold circuits.

5. A mixture control system as claimed in claim 4, wherein said time-varying current is synchronized with the speed of said engine.

6. A mixture control system as claimed in claim 1, wherein said time-varying current is an alternating current, and wherein said detector comprises a highpass filter for transmitting currents above the frequency of said time-varying current.

7. A mixture control system as claimed in claim 1, further comprising means for disabling the injection of said time-varying current in response to the generation of said output signal from said comparator.

8. A mixture control system as claimed in claim 7, further comprising means for delaying the disablement of said feedback control signal for an interval sufficient to allow said exhaust gas sensor to resume its normal operating condition after said injected current is disabled.

9. A mixture control system as claimed in claim 8, further comprising means for adjusting said feedback control signal to a predetermined voltage level during said delay interval.

10. A mixture control system as claimed in claim 1, further comprising means for discriminating the output signal of said comparator of a duration longer than a predetermined value against said output signal having a duration shorter than said predetermined value, and means for detecting the presence of warm-up condition of said engine to disable said discriminated longer duration signal.

11. A mixture control system as claimed in claim 1, further comprising a second comparator for comparing said voltage signal with a reference level corresponding to a low voltage condition of said exhaust gas sensor to generate an output signal indicating that said exhaust gas sensor has failed due to disconnection or short-circuit condition for disabling said feedback control signal.

12. A mixture control system as claimed in claim 11, further comprising a fault indicator responsive to said output signal from said second comparator for indicating the presence of said failure condition of said exhaust gas sensor.

* * * * *